US010132468B2

(12) United States Patent
Kim et al.

(10) Patent No.: US 10,132,468 B2
(45) Date of Patent: Nov. 20, 2018

(54) HIGH POWER LED LIGHTING DEVICE

(71) Applicant: KMW INC., Hwaseong, Gyeonggi-Do (KR)

(72) Inventors: Duk Yong Kim, Gyeonggi-Do (KR); Hyun Ki Kim, Seoul (KR); Dong Sik Roh, Seoul (KR)

(73) Assignee: GIGATERA INC., Hwaseong-si (KR)

( * ) Notice: Subject to any disclaimer, the term of this patent is extended or adjusted under 35 U.S.C. 154(b) by 0 days.

(21) Appl. No.: 14/478,644

(22) Filed: Sep. 5, 2014

(65) Prior Publication Data

US 2015/0267876 A1 Sep. 24, 2015

(30) Foreign Application Priority Data

Sep. 6, 2013 (KR) ..... 10-2013-0107477
Mar. 18, 2014 (KR) ..... 10-2014-0031532

(51) Int. Cl.

| | |
|---|---|
| ***F21V 21/30*** | (2006.01) |
| ***F21V 7/00*** | (2006.01) |
| *F21V 21/14* | (2006.01) |
| *F21V 21/26* | (2006.01) |
| *F21V 21/28* | (2006.01) |
| *F21W 131/105* | (2006.01) |

(Continued)

(52) U.S. Cl.

CPC ..... *F21V 7/0083* (2013.01); *F21V 21/30* (2013.01); *F21V 21/26* (2013.01); *F21V 21/28* (2013.01); *F21V 29/773* (2015.01); *F21W 2131/105* (2013.01); *F21Y 2105/10* (2016.08); *F21Y 2113/00* (2013.01); *F21Y 2115/10* (2016.08)

(58) Field of Classification Search

CPC ..... F21V 17/10; F21V 17/107; F21V 21/10; F21V 21/108; F21V 21/116; F21V 21/26–21/29; F21V 7/0083; F21V 21/30; F21K 9/00

See application file for complete search history.

(56) References Cited

U.S. PATENT DOCUMENTS 6,384,877 B1 * 5/2002 Socias Batet ..... A63B 71/06 348/842
7,281,818 B2 * 10/2007 You ..... F21V 7/0083 257/88

(Continued)

FOREIGN PATENT DOCUMENTS

CN 101758259 A 6/2010
CN 102003630 4/2011

(Continued)

OTHER PUBLICATIONS

European Search Report dated Mar. 17, 2017 in corresponding European Patent Application No. 14 796 654.3.

*Primary Examiner* — Karabi Guharay
*Assistant Examiner* — Nathaniel Lee
(74) *Attorney, Agent, or Firm* — Mintz Levin Cohn Ferris Glovsky and Popeo, P.C.; Kongsik Kim; Jhongwoo Jay Peck

(57) ABSTRACT

A high power LED lighting device is provided that includes a case, a substrate disposed in the case and including a plurality of LED chips are mounted thereon, and a reflection module connected to the substrate and including a plurality of light reflection semi-spheres protruding from a plate body. The device provides improved heat discharging properties, among others.

12 Claims, 10 Drawing Sheets

(51) Int. Cl.

| | |
|---|---|
| *F21V 29/77* | (2015.01) |
| *F21Y 113/00* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 2007/0189019 | A1* | 8/2007 | Klipstein | F21S 6/003 362/347 |
| 2008/0212329 | A1* | 9/2008 | Duguay | F21S 8/086 362/310 |
| 2012/0327645 | A1 | 12/2012 | You et al. | |
| 2013/0033867 | A1 | 2/2013 | Coplin et al. | |
| 2013/0148351 | A1* | 6/2013 | Georgitsis | F21V 21/14 362/239 |
| 2013/0215611 | A1 | 8/2013 | Wong et al. | |
| 2014/0334149 | A1* | 11/2014 | Nolan | F21V 5/007 362/235 |

FOREIGN PATENT DOCUMENTS

| | | | |
|---|---|---|---|
| CN | 202733483 | U | 2/2013 |
| JP | 4-87110 | U | 7/1992 |
| JP | 2008-159341 | A | 7/2008 |
| JP | 2009-87644 | A | 4/2009 |
| JP | 2010-262846 | A | 11/2010 |
| JP | 3164202 | U | 11/2010 |
| JP | 2012-09280 | A | 1/2012 |
| JP | 2013-062154 | A | 4/2013 |
| JP | 2013-134853 | A | 7/2013 |
| KR | 10-0770610 | | 10/2007 |
| KR | 10-0945420 | B1 | 3/2010 |
| KR | 20-2012-0006451 | | 9/2012 |
| KR | 101298576 | B1 | 8/2013 |
| WO | WO-12161426 | A2 | 11/2012 |
| WO | WO-2012/172688 | A1 | 12/2012 |

* cited by examiner

HIGH POWER LED LIGHTING DEVICE

CROSS-REFERENCE TO RELATED APPLICATIONS

The present application claims priority to Korean Application No. 10-2013-0107477 filed on Sep. 6, 2013 and Korean Application No. 10-2014-0031532 filed on Mar. 18, 2014, which applications are incorporated herein by reference.

TECHNICAL FIELD

The present invention relates to a high power light emitting diode (LED) lighting device, and more particularly to a high power LED lighting device capable of lighting a wide area.

BACKGROUND

Generally, an outdoor stadium such as a baseball field, a football field, sports complex and the like has lighting towers. The light tower is required to produce a relatively high output to light a playing field during a match, and consumes substantial amounts of electric power. Recently, technologies using LED lighting have been developed to reduce electric power consumption for the lighting of playing fields or similar areas.

A recently developed device in the related art includes a floodlight for a playing field that uses an LED lamp. The LED floodlight has a structure with a lens assembled with each LED. However, although an LED chip of about 1 watt is used for a high power LED lighting device requiring an output equal to or greater than about 800 watts, at least 840 LED chips must be used in the LED lighting device in consideration of a loss of light. Accordingly, the time required to couple a lens to each LED substantially increases which thus decreases productivity.

Further, a structure of adjusting an angle of the floodlight was developed, in which an angle of the floodlight is adjusted upwardly and downwardly and then a hinge is tightened and secured by a bolt. However, a coupling force acts on the floodlight to change the adjusted angle of the floodlight when the bolt is tightened, resulting in a deviation from a desired angle change.

In addition, although a high power LED lighting device is designed considering a weight and a volume of the LED lighting device, generally, the high power LED lighting device usually has a predetermined area since it is substituted for a conventional lighting device instead of being built specifically for an LED lighting device. As described above, at least 840 LED chips must be used to implement the high power LED lighting device with a capability of about 800 watts, and a reflector must protrude at a sufficient height from a light emitting surface of the LED chips to reflect lights emitted from all LED chips to form a desired light distribution. This causes an increase in weight and volume of the high power LED lighting device.

SUMMARY

The present invention provides a high power LED lighting device that may reduce assembling time to improve productivity. Additionally, the present invention provides a high power LED light device in which another heat source may be separated from the LED lighting device to enhance durability of the LED lighting device and also the heat source and the LED lighting device may be individually changed. The present invention also provides a high power LED lighting device having a reduced volume and weight. Also, the present invention provides a high power LED lighting device of which a light emitting angle may be adjusted when necessary without causing a deviation from a desired angle change after the angle is adjusted.

A high power LED lighting device in accordance with an aspect of the present invention may include a case, a substrate disposed in the case and including a plurality of LED chips are mounted thereon, and a reflection module connected to the substrate and including a plurality of light reflection semi-spheres protruding from a plate body. The case may include a plurality of heat radiation fins on a surface thereof. The high power LED lighting device may further comprise an electric power supplying unit connected to the case by a connector such that at least a portion of the electric power supplying unit is spaced apart from at least a portion of the case. The connector may be made of a material having a lower thermal conductivity that that of the electrical supplying unit. Preferably, the electric power supplying unit may include a plurality of heat radiation fins on a surface thereof. The high power LED lighting device may further comprise an angle adjustment unit including at least one hinge, an end of the angle adjustment unit being connected to the case and another end thereof being connected to the electric power supplying unit, wherein an angle of the lighting unit is adjusted by action of the at least one hinge. In some embodiments, the light reflection semi-spheres may be disposed to correspond to the LED chips one on one.

A high power LED lighting device in accordance with another aspect of the present invention may include a case, a substrate disposed on an inner surface of the case, and a reflection module connected to the substrate. The substrate may include a plurality of LED chips mounted and spaced apart by a predetermined distance from each other in a row direction, a column direction, or both on the substrate. The reflection module may include a plurality of light reflection semi-spheres to reflect light emitted from the LED chips to achieve a predetermined light distribution.

High power LED lighting devices according to this and other embodiments of the present invention have various advantages, including, but not limited to, improved assembling and/or repairing operation, improved heat discharging properties, improved manufacturing efficiency and productivity, and improved reliability and convenience.

BRIEF DESCRIPTION OF DRAWINGS

The above and other aspects, features, and advantages of the present invention will be more apparent from the following detailed description taken in conjunction with the accompanying drawings, in which.

DETAILED DESCRIPTION

Figure 1:
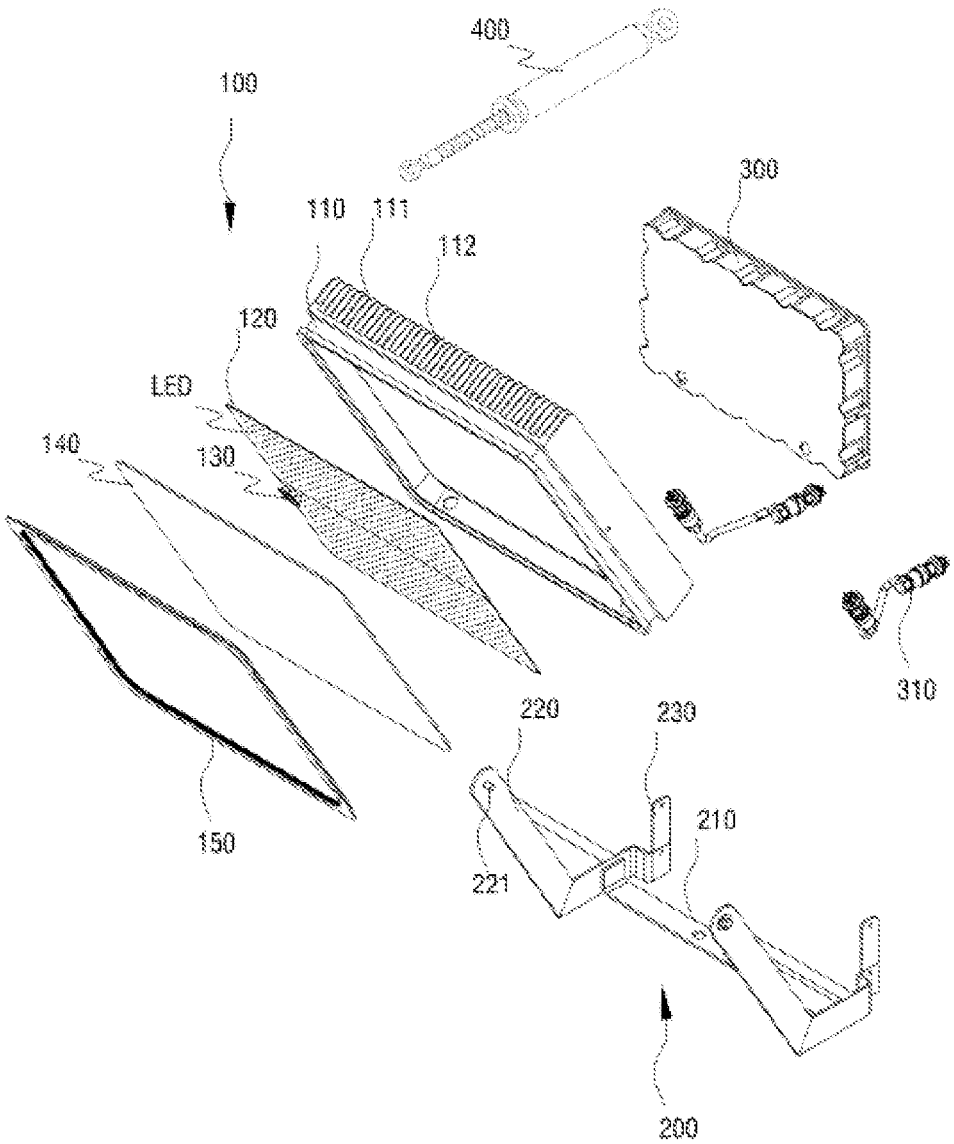
FIG. 1 is a perspective view illustrating a dissembled state of a high power LED lighting device according to an exemplary embodiment of the present invention.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Hereinafter, high power LED lighting devices according to embodiments of the present invention will be described in detail with reference to the accompanying drawings.

Figure 2:
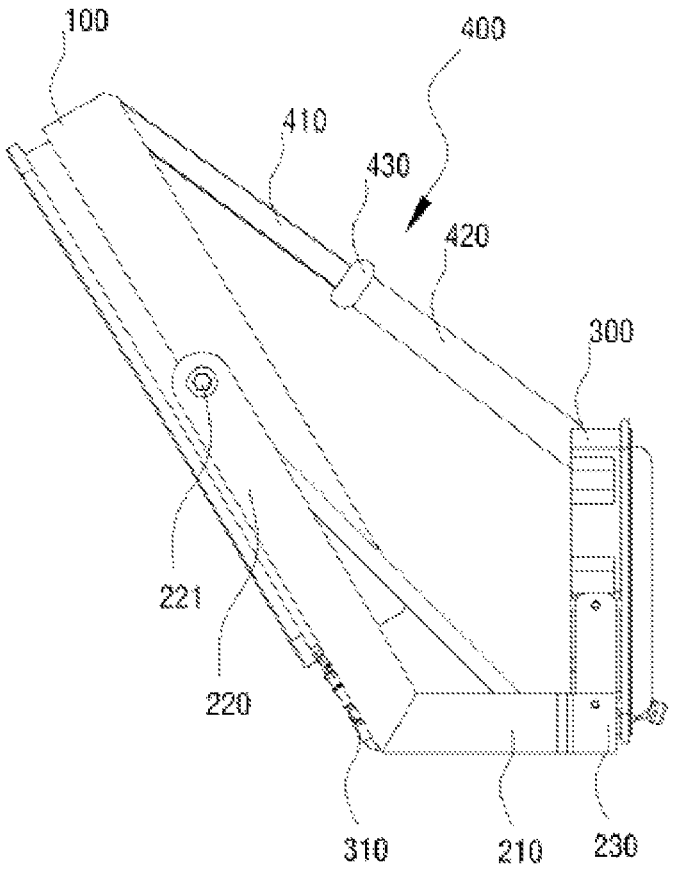
FIG. 2 is a sectional view illustrating an assembled state of the high power LED lighting device of FIG. 1.

FIG. 1 is a perspective view illustrating a dissembled state of a high power LED lighting device according to an exemplary embodiment of the present invention and FIG. 2 is a sectional view illustrating an assembled state of the high power LED lighting device. Referring to FIGS. 1 and 2, the high power LED lighting device according to the exemplary embodiment of the present invention includes a lighting unit 100. It may further include a supporting frame 200, an electric power supplying unit 300, and an angle adjustment unit 400. The lighting unit 100 includes a plurality of LED chips that can produce a desired output (e.g., about 400 watts, 800 watts, 1200 watts, etc.). The supporting frame 200 is connected to the lighting unit 100 for adjusting an angle of the lighting unit 100. The electric power supplying unit 300 for converting an alternate current into a direct current to be supplied to the lighting unit 100 is connected to the supporting frame 200 such that at least a portion of the electric power supplying unit 300 is spaced apart from at least a portion of the lighting unit 100. An end of the angle adjustment unit 400 may be hingedly or non-hingedly connected to the lighting unit 100 and the other end of the angle adjustment unit 400 may be hingedly or non-hingedly connected to the electric power supplying unit 300 such that the angle of the lighting unit 100 with respect to a ground surface can be changed.

The lighting unit 100 includes a case 110, a substrate 120, and reflection modules 130. The LED chips are arranged and spaced apart by about an equal distance from each other on the substrate 120. The case 110 receives the substrate 120 in/on an inner side thereof. The case 110 may, preferably, have a plurality of heat radiation fins 111 on a surface thereof. The reflection modules 130 may be mounted on the substrate 120 to reflect and distribute light emitted from each of the LED chips. The lighting unit 100 may further include a cover 140 configured to cover an outer surface of the reflection modules 130. A reference numeral 150 denotes a frame configured to fix the cover 140, and a reference numeral 310 indicates a wire connector between the electric power supplying unit 300 and the substrate 120 (and/or the case 110).

Figure 3:
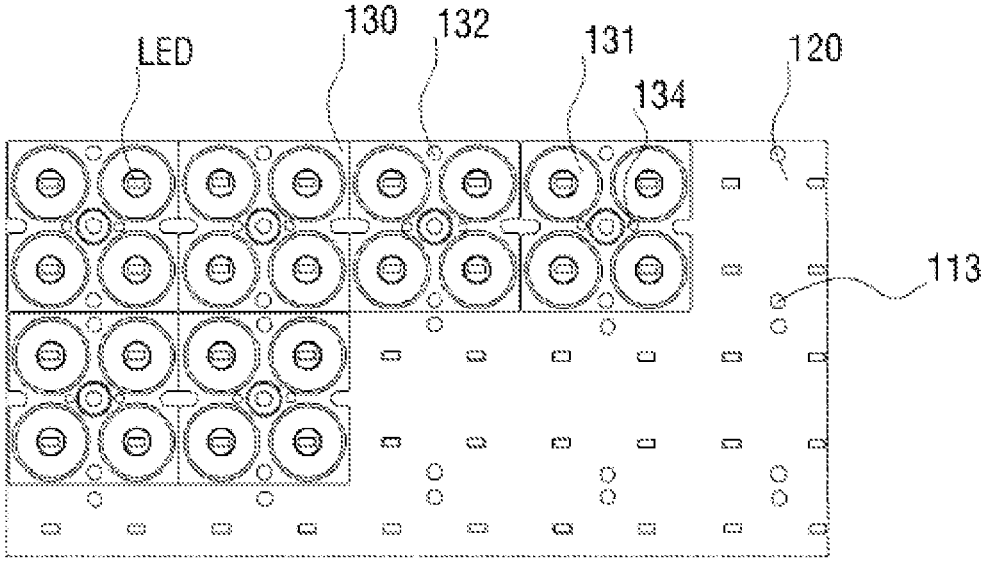
FIG. 3 illustrates a reflection module mounted on a front surface of a substrate of the high power LED lighting device of FIG. 1.
Figure 4:
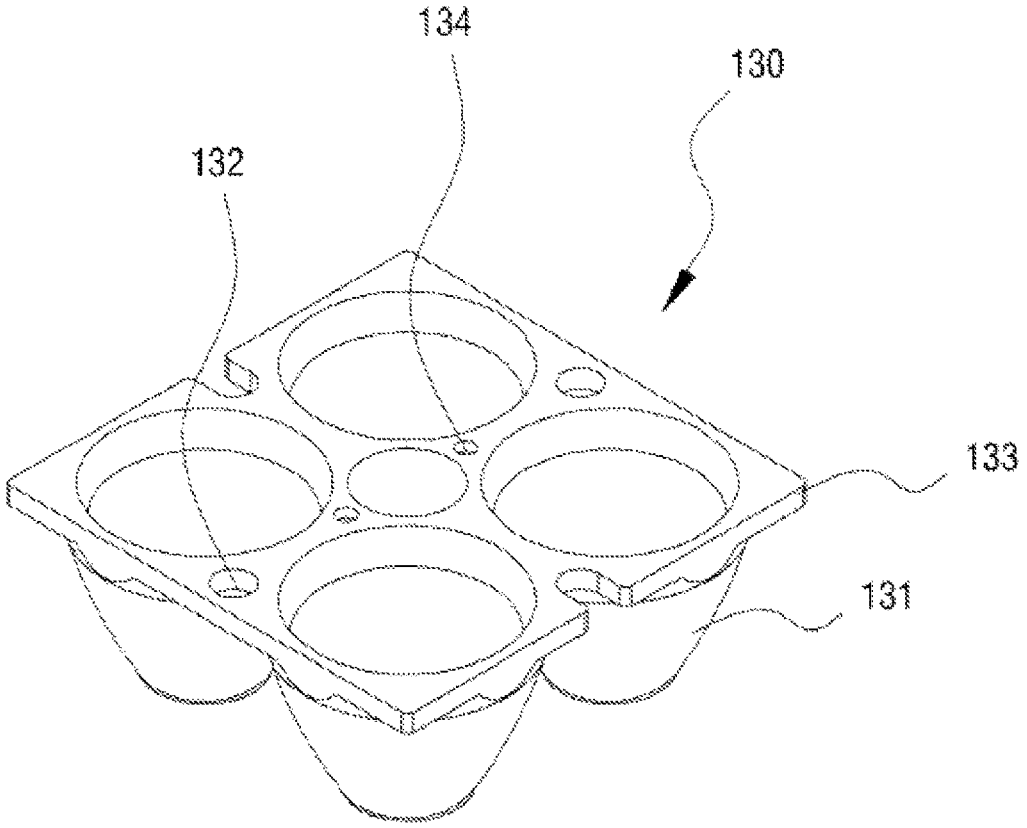
FIG. 4 is a perspective view illustrating a reflection module that can be applied to a high power LED lighting device according to an exemplary embodiment of the present invention.

Referring to FIGS. 3 and 4, multiple LED chips (e.g., 840 1-watt LED chips, 1680 0.5-watt LED chips, etc.) may be arranged and spaced apart by about an equal distance from each other on the substrate 120. When the LED chips are arranged and spaced apart by about an equal distance, an operation of mounting the LED chips on the substrate 120 may be facilitated and a design for mounting the reflection modules 130 may be simplified. In particular, the substantially equal distance arrangement of the LED chips makes the LED chips spaced apart from each other maximally, thereby increasing the effect on heat radiation (discharging) performance.

At least one coupling protrusion 113 protrudes from a surface of the case 110. At least one coupling aperture 132 is defined in the reflection module 130. At least one connection hole (not shown) is defined in the substrate 120 at positions corresponding to the coupling holes 132. The coupling protrusion(s) 113 extends through the connection hole(s)) formed in the substrate 120 and is inserted into the coupling aperture(s) 132 formed in the reflection module 130. In this state, for example, a fastening mechanism (e.g., a coupling a bolt) may be used to couple the reflection module 130 to the substrate 120.

Each reflection module 130 may, preferably, include at least two light reflection semi-spheres 131 arranged in row and/or column directions (e.g., 1×2, 2×1, 1×3, 2×2, 3×1, 1×4, 2×3, 3×2, 4×1, 1×5, 2×4, 3×3, 4×2, 5×1, etc.). The number and size of light reflection semi-spheres disposed in one reflection module 130 may be appropriately determined depending on desired design specifications and/or customer needs. For example, in case of a 2×2 reflection module as shown in FIG. 4, four light reflection semi-spheres 131 configured to reflect light emitted from four LED chips may be simultaneously mounted, thus being able to simplify assembling operation. A light reflection semi-sphere 131 may correspond to one or more LED chips. The depth of a light reflection semi-sphere 131 and the curvature of an inner surface of the light reflection semi-sphere 131 may be appropriately set to produce a desired light distribution, depending on desired design specifications and/or customer needs. Further, luminous flux reflected and discharged by one light reflection semi-sphere 131 may be appropriately set (e.g., to be about 101 m) depending on desired design specifications and/or customer needs.

Figure 5A:
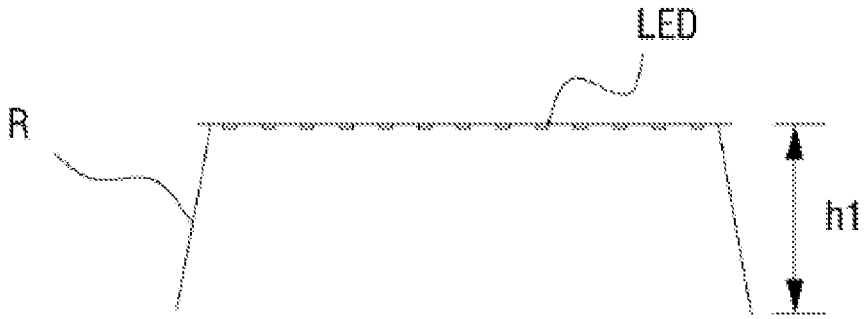
FIG. 5A Prior Art
FIGS. 5A-5B illustrate a conventional reflection plate and a reflection module according to an embodiment of the present invention, respectively.
Figure 5B:
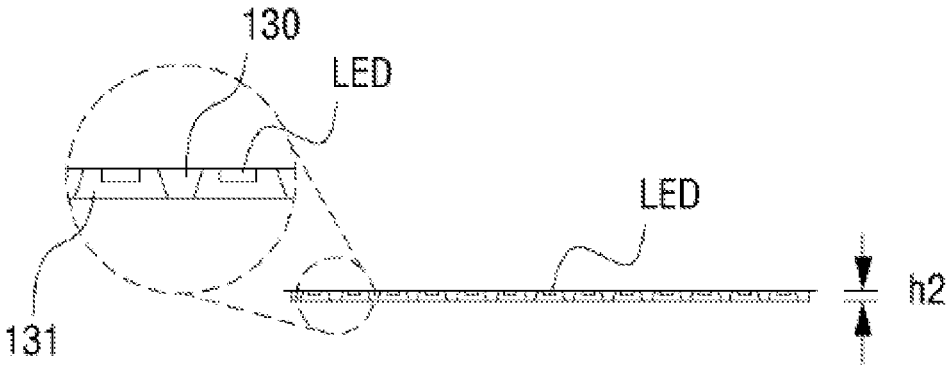

FIGS. 5A and 5B illustrate a conventional reflection plate and a reflection module according to an embodiment of the present invention, respectively. As shown in FIG. 5A, in a conventional LED lighting device using a conventional reflection plate, in which a plurality of LED chips are mounted on a substrate and a reflection unit R is formed at edges of the substrate, the height h1 of the reflection unit must be great enough to obtain a desired light distribution. In particular, since an emitting angle of light emitted through a light emitting surface of LED chips placed at about a center of the substrate among the plural LED chips is about 120 degrees, the reflection unit R may not reflect the light emitted from the LED chips placed at about the center of the substrate when the height of the reflection unit R is insufficient, or may not form a desired light distribution. On the other hand, as shown in FIG. 5B according to an exemplary embodiment of the present invention, the reflection module 130 has the light reflection semi-spheres 131 that correspond to the plurality of LED chips (here, one on one), the respective light reflection semi-spheres 131 may reflect light emitted from respective LED chips and form a desired light distribution. Accordingly, the height h2 of the reflection module 130 may be smaller than the height h1 of the reflection unit R. The above mentioned structure of the reflection module may decrease the volume and weight of the high power LED lighting device and reduce a manufacturing cost.

The light reflection semi-spheres 131 with a predetermined height may, preferably, be formed integrally with and protrude from a plate-shaped body 134, allowing the weight of the reflection module 130 to be reduced in comparison with a single light reflection sphere formed on a structure of a hexahedron. The reduction of the weight of the reflection module 130 allows facilitation of an operation of coupling the reflection module 130 to the substrate 120, and in addition results in a reduction of the lighting device to facilitate the transportation and mounting of the lighting device.

As described above, a plurality of the reflection modules 130 may be arranged on a surface (e.g., a front surface) of the substrate 120, and then the cover 140 may be fixed to a front surface of the case 110 to assemble the lighting unit 100. The cover 140 may be made of a transparent sheet to minimize the loss of light and prevent an introduction of a foreign substance (e.g., dust, etc.).

A plurality of the heat radiation fins 111 may, preferably, be arranged on another surface (e.g., a rear surface) of the case 110. The number, shape, and position of the heat radiation fins 111 may be appropriately determined depending on desired design specifications and/or customer needs. For example, the heat radiation fins 111 may be formed horizontally, diagonally, vertically, or a combination thereof on a rear surface of the case 10.

The lighting unit 100 may be rotatably connected to the supporting frame 200. An end of the supporting frame 200 may be hingedly or non-hingedly connected to the lighting unit 100 and another end of the supporting frame 200 may be hingedly or non-hingedly connected to the electric power supplying unit 300. Alternatively, the supporting frame 200 may include a lighting unit fixing frame 220, an electric power supplying unit fixing frame 230, and a base frame 210 between the lighting unit fixing frame 220 and the electric power supplying unit fixing frame 230. The lighting unit fixing frame 220 may extend at a predetermined angle from at least a portion of the base frame 210 to at least a portion of the lighting unit 100. The power supplying unit fixing frame 230 may extend at a predetermined angle from at least a portion of the base frame 210 to at least a portion of the electric power supplying unit 30.

The electric power supplying unit 300 is configured to convert an alternate current into a direct current and supply the direct current to the lighting unit 100. Since heat can be generated by the electric power supplying unit 300, at least a portion of the electric power supplying unit 300 may, suitably, be disposed to be spaced from at least a portion of the lighting unit 100 to prevent the generated heat from being transferred to the lighting unit 100. As such, heat generated by the lighting unit 100 may be prevented from being transferred to the electric power supplying unit 300 and heat generated by the electric power supplying unit 300 may be prevented from being transferred to the lighting unit 100, thereby preventing damage of the LED lighting device due to heat or degradation of the durability thereof.

If both the electric power supplying unit 300 and the lighting unit 100 are disposed in a case, the electric power supplying unit 300 must be separated from the case to be substituted with a new one, which is inconvenient. On the other hand, according to the present invention, since the electric power supplying unit 300 is disposed separately from the lighting unit 100 disposed in the case 110 and/or since the electric power supplying unit 300 is mounted independently on the exterior, it is possible to facilitate the substitution of the electric power supplying unit 300. More specifically, the electric power supplying unit 300 may be separated from the power supplying unit fixing frame 230 and a new power supplying unit 300 may be mounted on the LED lighting device, thereby being able to more easily complete a maintenance operation.

The angle adjustment unit 400 may include at least one hinge. An end of the angle adjustment unit may be hingedly or non-hingedly connected to at least a portion of the lighting unit and another end thereof may be hingedly or non-hingedly connected to at least a portion of the electric power supplying unit. The angle of the lighting unit (e.g., with respect to a ground surface) may be adjusted by action of the at least one hinge.

In a modified embodiment, a first end of the angle adjustment unit 400 may be hingedly or non-hingedly connected to at least one of the heat radiation fins 111 of the lighting unit 100 or at least a portion of the case 110. A second end of the angle adjustment unit 400 may be hingedly or non-hingedly connected to at least one of the heat radiation fins provided to the electric power supplying unit 300 or at least a portion of the electric power supplying unit 300.

In some embodiments, the angle adjustment unit 400 may include a screw 410, a receiving part 420 configured to receive the screw 410, and a rotation controller 430 configured to rotate in an idle manner and mounted at a position adjacent to the screw 410. When the rotation controller 430 is rotated, the screw 410 may be received in or withdrawn from the receiving part 420 to increase or decrease an exposed portion of the screw.

To adjust the angle of the lighting unit 100 (with respect to a ground surface) using the angle adjustment unit 400, a bolt 221 of the lighting unit fixing frame 220 may be loosened to allow the lighting unit 100 to be rotatable around a coupling position of the bolt 221.

Thereafter, the rotation controller 430 is rotated to move the screw 410. The angle of the lighting unit 100 may be adjusted in accordance with the length of the screw exposed to exterior of the receiving part 430. The length of the screw exposed to exterior of the receiving part 430 increases or decreases according to the rotation direction and degree of the rotation controller 430. It is possible to calculate the length of the screw 410 adjusted per one rotation of the rotation controller 430. Thus, operators may adjust the angle of the lighting unit 100 to a desired angle.

After adjusting the angle of the lighting unit 100 to a desired angle as described above, the bolt 221 may be tightened to fix the lighting unit 100 to the lighting unit fixing frame 220. When the bolt 221 is securely tightened so that the lighting unit is tightly fixed to the lighting unit fixing frame 220, since the lighting unit 100 is secured by a predetermined force of the angle adjustment unit 400, it is possible to prevent the angle of the lighting unit 100 from being deviated from a desired angle. Accordingly, the lighting unit 100 may be adjusted to a desired angle and maintained at the desired angle stably and reliably.

Figure 6:
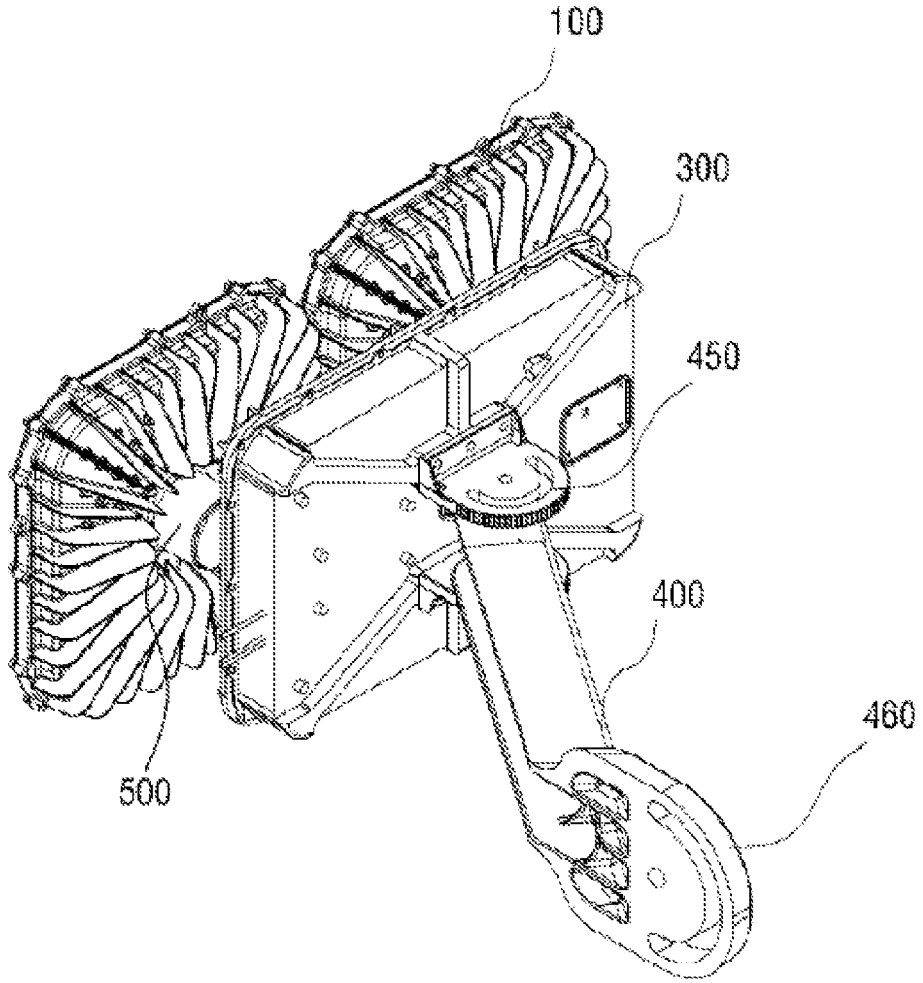
FIGS. 6 to 8 are perspective, rear, and front views of a high power LED lighting device according to another exemplary embodiment of the present invention, respectively.
Figure 7:
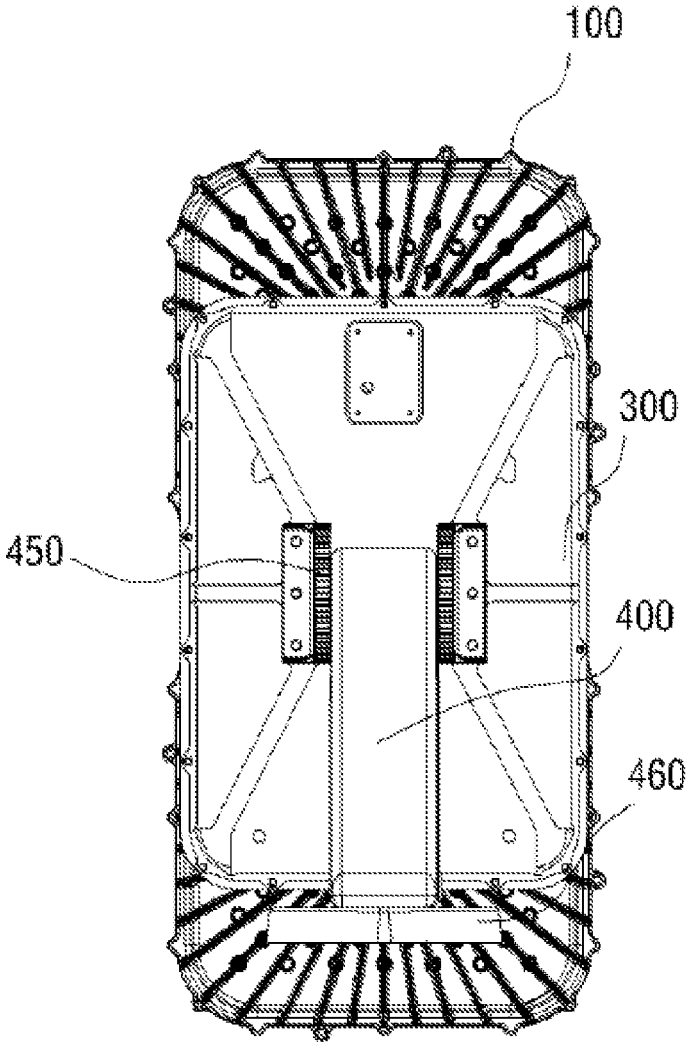
Figure 8:
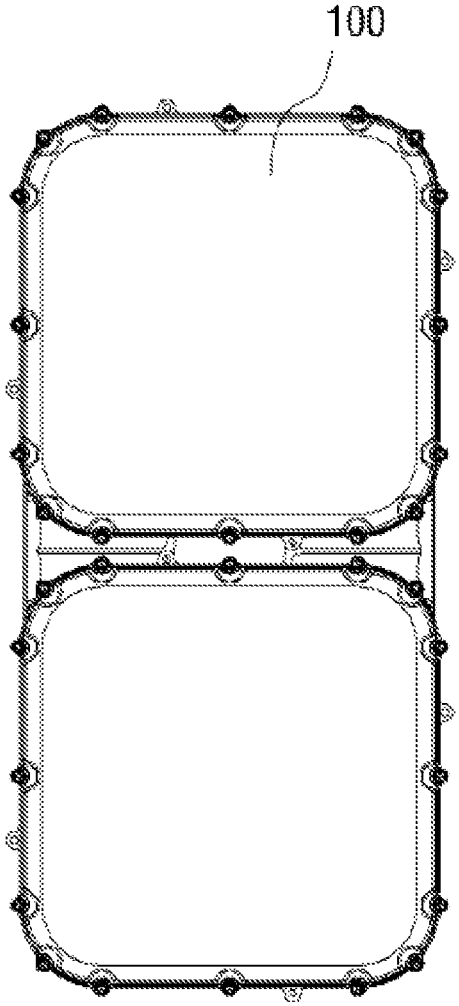

One lighting unit 100 may have a pre-determined output (e.g., about 400 watts, 800 watts, etc.). In accordance with desired design specifications or customer needs, a plurality of the lighting units 100 may be assembled. For example, FIGS. 6 to 8 are perspective, rear, and front views of a high power LED lighting device according to another exemplary embodiment of the present invention, respectively. The high power LED lighting device according to this embodiment may include an electric power supplying unit 300 and a first and second lighting units 100 connected to at least a portion of the electric power supplying unit 300 by at least one connector 500. The high power LED lighting device may further include an angle adjustment unit 400 connected to a surface of the electric power supplying unit 300 to adjust the angle of the pair of the lighting unit 100 along with the electric power supplying unit 300.

In this embodiment, the first and second lighting units 100 may be independently mounted. The first and second lighting units 100 each may radiate heat through heat radiation fins provided on the respective cases as described above, it is possible to prevent the degradation of the durability of the LED chips caused by generated heat even when the LED lighting device is applied to the high power lighting device.

Furthermore, since at least a portion of the lighting unit 100 and at least a portion of the electric power supplying unit 300 are spaced at a sufficient distance from each other, heat transfer between the lighting unit 100 and the electric power supplying unit 300 may be prevented. In a modified embodiment, the at least one connector 500 that connects the lighting units 100 with the electric power supplying unit 300 may be made of a material with a substantially low thermal conductivity to minimize thermal transfer between the lighting unit 100 and the electric power supplying unit 300. In addition, since the angle adjustment unit 400 may include at least one hinge (e.g., a horizontal hinge 450, a vertical hinge 460, or a combination thereof), the angle (and height) of the electric power supplying unit 300 and the lighting unit 100 connected to the front surface of the electric power supplying unit 300 may be adjusted.

Figure 9:
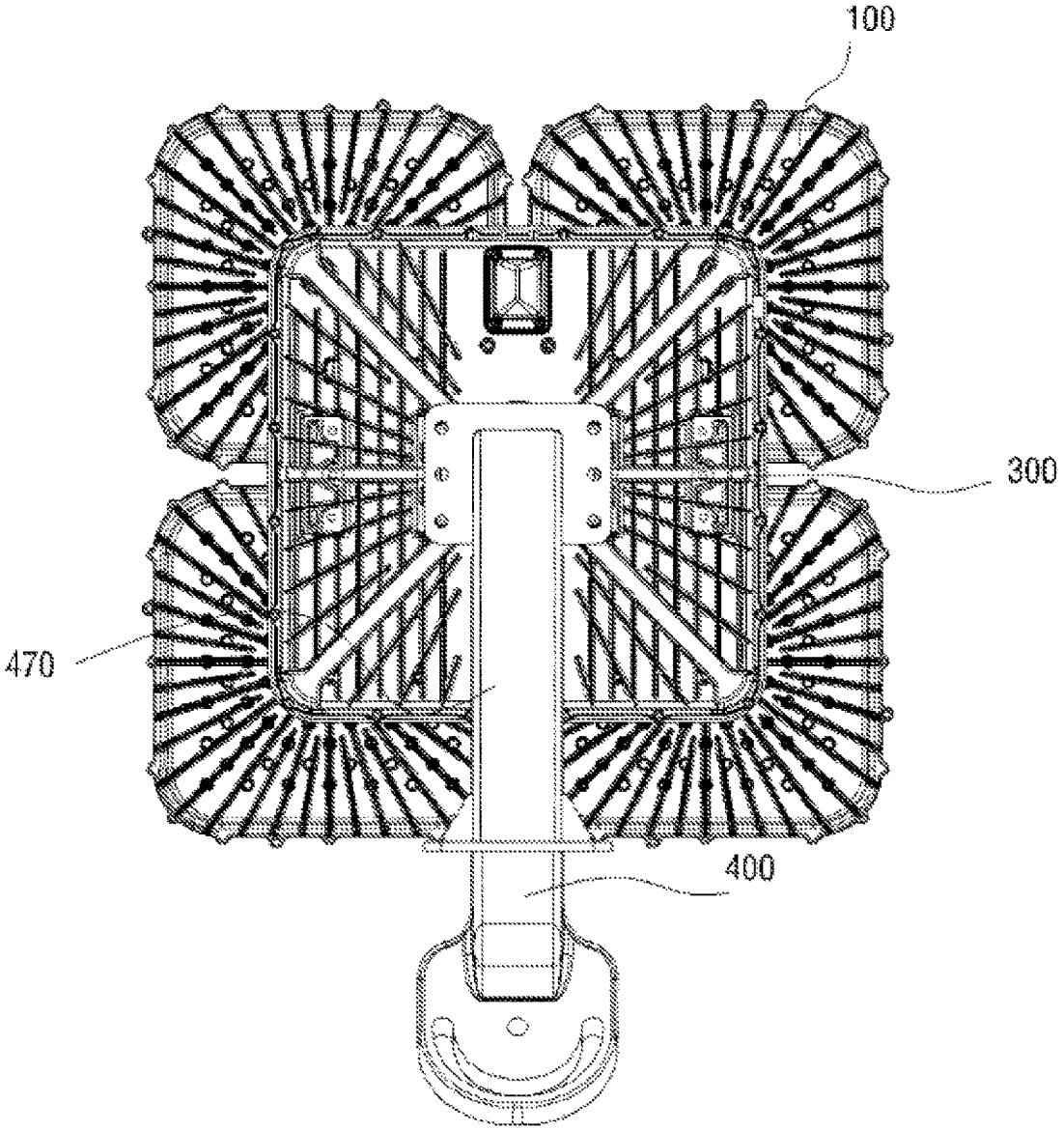
FIGS. 9 to 10 are rear and perspective views of a high power LED lighting device according to still another exemplary embodiment of the present invention, respectively.
Figure 10:
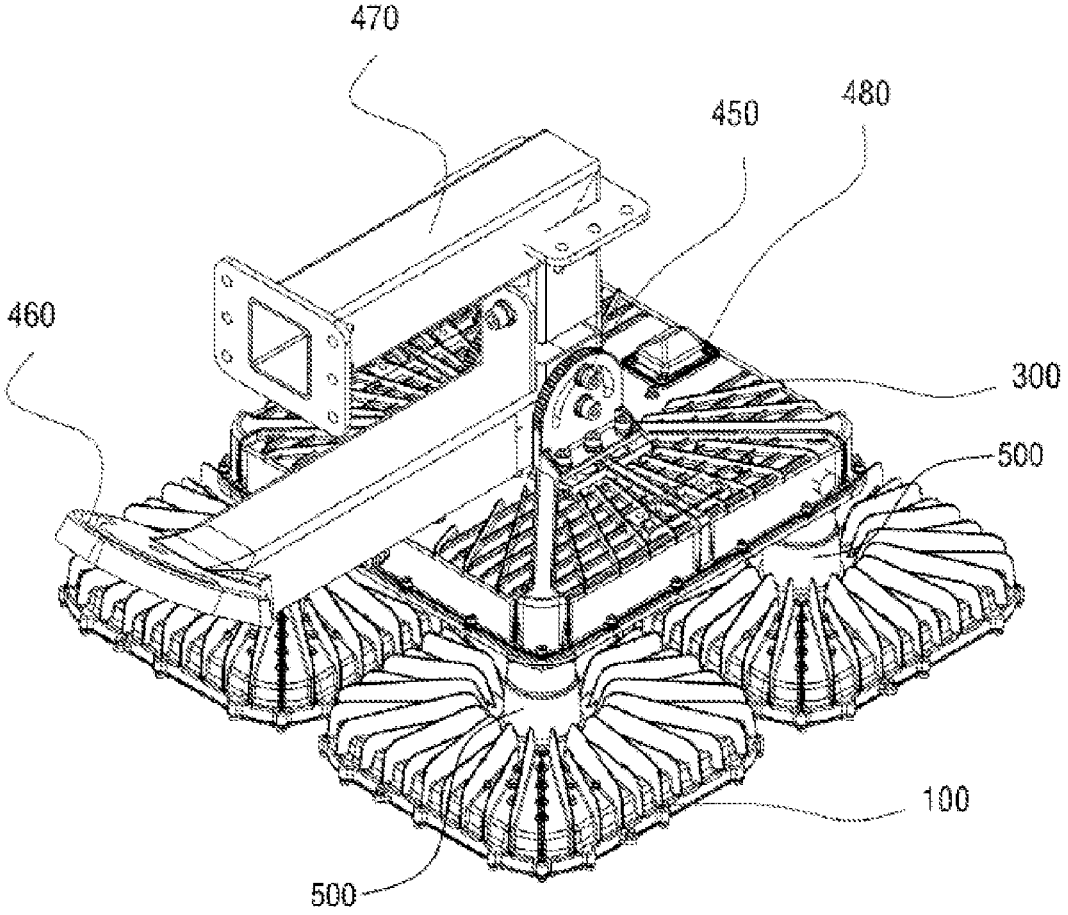

FIGS. 9 to 10 are rear and perspective views of a high power LED lighting device according to still another exemplary embodiment of the present invention, respectively. The high power LED lighting device according to this embodiment includes four lighting units 100 connected by at least one connector 500 to at least a portion of the electric power supplying unit 300.

The electronic power supplying unit 300 may, preferably, include the angle adjustment unit 400 on a surface thereof to adjust the angle of the lighting units 100. The angle adjustment unit 400 may include at least one hinge. A fixing frame 470 may be connected to the angle adjustment unit 400 to rigidly secure the LED lighting device to a fixture. Accordingly, the angle of the lighting units 100 can be adjusted before or after the LED lighting device is secured to a fixture.

The electric power supplying unit 300 may further include a signal receiving device 480 configured to receive a dimming control signal from an exterior and adjust electric power supplied to the lighting unit(s) 100 based on the dimming control signal. Accordingly, it is possible to more easily perform the dimming control of the lighting unit(s) 100 at the exterior.

High power LED lighting devices according to the above-described embodiments of the present invention have various advantages. For example, compared to prior art high power LED lighting devices, assembling operation is easier, volume and weight are smaller, heat discharging efficiency is greater, performance is more reliable, maintenance is easier, and an angle deviation can be more easily avoided, among others.

Although the present invention has been described with reference to the exemplary embodiments, it is obvious to those skilled in the art to which the present invention belongs that the present invention is not limited to the exemplary embodiments, and may be variously varied and modified without departing from the scope of the present invention.

What is claimed is:

1. A high power light emitting diode (LED) lighting device, comprising:

a case;

a substrate disposed on an inner surface of the case and including a plurality of LED chips mounted and spaced apart by a predetermined distance from each other in a row direction, a column direction, or both on the substrate;

a reflection module connected to the substrate and including a plurality of light reflection semi-spheres that are integrally formed and protrude from a plate-shaped body to reflect light emitted from the LED chips to achieve a predetermined light distribution;

a supporting frame configured to support the case;

an electric power supplying unit supported by the supporting frame to be spaced apart from the case;

at least one connector that connects the case with the electric power supplying unit; and an angle adjustment unit connected to one surface of the electric power supplying unit to adjust an angle of the case or to adjust the angle of the case along with the electric power supplying unit, wherein the electric power supplying unit has a plurality of heat radiation fins, and wherein the angle adjustment unit comprises:

a screw having a first end coupled to the case;

a receiving part aligned longitudinally with the screw having a first end coupled to the electric power supplying unit, a second end, and a recess formed on the second end in a longitudinal direction to receive the screw within the recess; and a rotation controller mounted on the second end of the receiving part to adjust a length of the angle adjustment unit by an insertion and a withdrawal of the screw into and out of the receiving part according to the rotation of the rotation controller, wherein the first end of the screw is coupled to the case by at least one hinge, the first end of the receiving part is coupled to the electric power supplying unit by at least one hinge, or both.

2. The high power LED lighting device as claimed in claim 1, wherein at least one coupling aperture is formed in the plate-shaped body and at least one coupling protrusion formed on the case such that the coupling protrusion or protrusions can be inserted into the coupling aperture or apertures.

3. The high power LED lighting device as claimed in claim 1, wherein the case includes a plurality of heat radiation fins on a surface thereof.

4. The high power LED lighting device as claimed in claim 1, wherein the LED chips are spaced apart by about an equal distance from each other.

5. The high power LED lighting device as claimed in claim 1, wherein the light reflection semi-spheres are disposed to correspond to the LED chips one on one.

6. The high power LED lighting device as claimed in claim 5, wherein a luminous flux reflected and emitted by one light reflection semi-sphere is equal to or greater than about 101 m.

7. A high power LED lighting device, comprising:

a case;

a substrate disposed in the case and including a plurality of LED chips are mounted thereon;

a reflection module connected to the substrate and including a plurality of light reflection semi-spheres are integrally formed and protruding from a plate body;

a supporting frame configured to support the case;

an electric power supplying unit spaced apart from the case;

at least one connector that connects the case with the electric power supplying unit; and an angle adjustment unit connected to one surface of the electric power supplying unit to adjust an angle of the case or to adjust the angle of the case along with the electric power supplying unit, wherein the electric power supplying unit has a plurality of heat radiation fins, and wherein the angle adjustment unit comprises:

a screw having a first end coupled to the case;

a receiving part aligned longitudinally with the screw and having a first end coupled to the electric power supplying unit, a second end, and a recess formed on the second end in a longitudinal direction to receive the screw; and a rotation controller mounted on the second end of the receiving part to adjust a length of the angle adjustment unit by an insertion and a withdrawal of the screw into and out of the receiving part according to the rotation of the rotation controller, wherein the first end of the screw is coupled to the case by at least one hinge, the first end of the receiving part is coupled to the electric power supplying unit by at least one hinge, or both.

8. The high power LED lighting device as claimed in claim 7, wherein the case includes a plurality of heat radiation fins on a surface thereof.

9. The high power LED lighting device as claimed in claim 7, further comprising an electric power supplying unit connected to the case by a connector such that at least a portion of the electric power supplying unit is spaced apart from at least a portion of the case.

10. The high power LED lighting device as claimed in claim 9, wherein the connector is made of a material having a lower thermal conductivity that that of the electrical supplying unit.

11. The high power LED lighting device as claimed in claim 9, wherein the electric power supplying unit includes a plurality of heat radiation fins on a surface thereof.

12. The high power LED lighting device as claimed in claim 7, wherein the light reflection semi-spheres are disposed to correspond to the LED chips one on one.

* * * * *